US010074892B2

(12) United States Patent
Wong et al.

(10) Patent No.: US 10,074,892 B2
(45) **Date of Patent: *Sep. 11, 2018**

(54) COMMUNICATION DEVICE WITH METAL-FRAME HALF-LOOP ANTENNA ELEMENT

(71) Applicant: Acer Incorporated, New Taipei (TW)

(72) Inventors: Kin-Lu Wong, New Taipei (TW); Hsuan-Jui Chang, New Taipei (TW)

(73) Assignee: Acer Incorporated, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/807,591

(22) Filed: Nov. 9, 2017

(65) Prior Publication Data

US 2018/0090822 A1 Mar. 29, 2018

Related U.S. Application Data

(63) Continuation of application No. 15/216,424, filed on Jul. 21, 2016, now Pat. No. 9,853,351.

(30) Foreign Application Priority Data

May 23, 2016 (TW) ..... 105115954 A

(51) Int. Cl.
*H01Q 1/24* (2006.01)
*H01Q 7/00* (2006.01)
*H01Q 1/48* (2006.01)

(52) U.S. Cl.
CPC ..... *H01Q 1/243* (2013.01); *H01Q 1/48* (2013.01); *H01Q 7/00* (2013.01)

(58) Field of Classification Search
None
See application file for complete search history.

(56) References Cited

U.S. PATENT DOCUMENTS 9,024,823 B2 * 5/2015 Bevelacqua ..... H01Q 9/42 343/702
9,853,351 B2 * 12/2017 Wong ..... H01Q 1/243
2003/0098813 A1 * 5/2003 Koskiniemi ..... H01Q 9/0421 343/702
2003/0207701 A1 * 11/2003 Rolnik ..... H04M 1/274558 455/564
2004/0227678 A1 * 11/2004 Sievenpiper ..... H01Q 1/243 343/702

(Continued)

*Primary Examiner* — Trinh Dinh
(74) *Attorney, Agent, or Firm* — JCIPRNET

(57) ABSTRACT

A communication device includes a ground plane and an antenna element. The antenna element includes a radiation metal strip and a feed metal line. The radiation metal strip is divided into a first metal strip and a second metal strip by a gap. The first metal strip is electrically connected to the ground plane by a first metal section. The second metal strip is electrically connected to the ground plane by a second metal section. The feed metal line has a first to a third connection points. The first connection point is coupled to the first metal strip through a first capacitive element. The second connection point is coupled to the second metal strip through a second capacitive element. The third connection point is a feeding point of the antenna element. The second connection point is located between the first connection point and the third connection point.

16 Claims, 3 Drawing Sheets

(56) References Cited

U.S. PATENT DOCUMENTS

| | | | | |
|---|---|---|---|---|
| 2005/0168384 | A1* | 8/2005 | Wang | H01Q 1/22 343/700 MS |
| 2008/0266190 | A1* | 10/2008 | Ohba | H01Q 1/243 343/702 |
| 2009/0224996 | A1* | 9/2009 | Kim | H01P 1/18 343/860 |
| 2009/0273521 | A1* | 11/2009 | Wong | H01Q 1/38 343/700 MS |
| 2011/0260931 | A1* | 10/2011 | Tsai | H01Q 1/2266 343/702 |
| 2013/0057437 | A1* | 3/2013 | Chiu | H01Q 1/243 343/702 |
| 2015/0101976 | A1* | 4/2015 | Lee | B01D 63/026 210/323.2 |
| 2017/0162948 | A1* | 6/2017 | Wong | H01Q 5/10 |

* cited by examiner

COMMUNICATION DEVICE WITH METAL-FRAME HALF-LOOP ANTENNA ELEMENT

CROSS-REFERENCE TO RELATED APPLICATION

This is a continuation application of and claims the priority benefit of U.S. patent application Ser. No. 15/216,424, filed on Jul. 21, 2016, now allowed, which application claims the priority benefit of Taiwan application serial no. 105115954, filed on May 23, 2016. The entirety of each of the above-mentioned patent applications is hereby incorporated by reference herein and made a part of this specification.

BACKGROUND OF THE INVENTION

Field of the Invention

The invention relates to a communication device, particularly to a communication device having an antenna element.

Description of Related Art

Along with the rapid development of mobile communication technology, a variety of mobile communication products have been continuously introduced, wherein communication devices (e.g., smartphones and tablet PCs, etc.) are the most popular. There is a trend for these communication devices to have a lightweight and slim appearance. Today, appearance design and robustness of communication devices is becoming more and more important. Therefore, how to design a communication device having a slim appearance and a metal case and an antenna element applicable to such a communication device, e.g., to enable the antenna element to have wide-band or multi-band characteristics, and also to allow the metal case to only need a narrow clearance region (e.g., the clearance region having a width smaller than or greatly smaller than 4 mm) disposed at a frame of the metal case such that the communication device has a beautiful and slim appearance, has become a major issue to be solved.

SUMMARY OF THE INVENTION

The invention provides a communication device, such that the communication device only needs a narrow clearance region disposed at a frame of the communication device and configured to serve as an antenna window of an antenna element, so as to achieve a beautiful appearance and robustness of the communication device having a metal case.

The invention provides a communication device including a ground plane and an antenna element. The ground plane has a first edge. The antenna element includes a radiation metal strip and a feed metal line. Both the radiation metal strip and the feed metal line are extended along the first edge. The feed metal line is arranged between the radiation metal strip and the first edge. The radiation metal strip and the ground plane are separated by a clearance region, and the ground plane is not disposed in the clearance region. The radiation metal strip has a first end and a second end. The radiation metal strip is divided into a first metal strip and a second metal strip by a gap. The first metal strip has the first end, and the first end is electrically connected to the ground plane by a first metal section. The second metal strip has the second end, and the second end is electrically connected to the ground plane by a second metal section. The first metal strip is coupled to a first connection point on the feed metal line through a first capacitive element. The second metal strip is coupled to a second connection point on the feed metal line through a second capacitive element. The feed metal line has a third connection point as a feeding point of the antenna element. The second connection point is located between the first connection point and the third connection point.

In an embodiment of the invention, the third connection point on the feed metal line is coupled to a signal source of the communication device through a matching circuit. The radiation metal strip and the ground plane are not on the same surface. The radiation metal strip is disposed on a surface of a frame of the communication device or forms a part of a metal frame of the communication device. The first metal section and the second metal section are also a part of the metal frame of the communication device. A length of the radiation metal strip is not greater than a length of a short edge of the communication device.

In an embodiment of the invention, the clearance region has a width between 0.5 mm and 4.0 mm.

In an embodiment of the invention, a length of the first metal strip of the radiation metal strip is not greater than a length of the second metal strip. A length of the feed metal line is greater than the length of the first metal strip and smaller than the length of the second metal strip. The feed metal line, the first capacitive element, the first metal strip and the first metal section of the antenna element form a first half-loop path. The first half-loop path generates a first resonant mode, and the first resonant mode is in a first frequency band of the antenna element.

In an embodiment of the invention, the feed metal line, the second capacitive element, the second metal strip and the second metal section of the antenna element form a second half-loop path. The second half-loop path generates a second resonant mode, and the second resonant mode is in a second frequency band of the antenna element.

To make the above features and advantages of the invention more comprehensible, embodiments accompanied with drawings are described in detail as follows.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1:
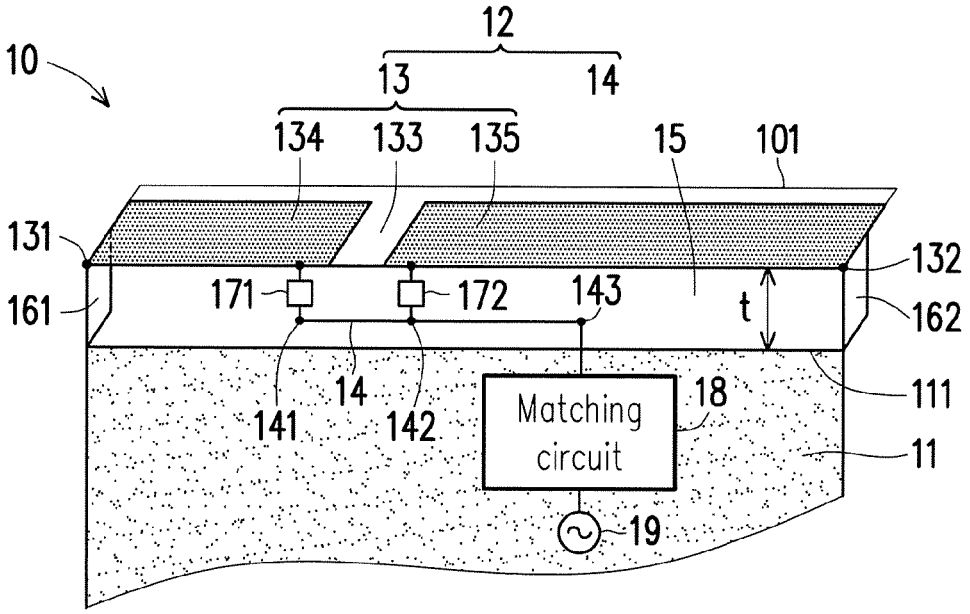
FIG. 1 is a structure diagram of a first embodiment of a communication device of the invention.

FIG. 1 is a structure diagram of the first embodiment of the communication device of the invention. As shown in FIG. 1, a communication device 10 is, for example, a device having a metal case, such as a smartphone or tablet PC, etc., and the communication device 10 includes a ground plane 11 and an antenna element 12. The ground plane 11 has a first edge 111. The antenna element 12 includes a radiation metal strip 13 and a feed metal line 14. Both the radiation metal strip 13 and the feed metal line 14 are extended along the first edge 111 of the ground plane 11. Specifically, the feed metal line 14 is located between the radiation metal strip 13 and the ground plane 11. Moreover, the feed metal line 14 and the radiation metal strip 13 are parallel to the first edge 111. The radiation metal strip 13 and the ground plane 11 are separated by a clearance region 15, and the ground plane 11 is not disposed in the clearance region 15.

The radiation metal strip 13 has a first end 131 and a second end 132, and the radiation metal strip 13 is divided into a first metal strip 134 and a second metal strip 135 by a gap 133. The first metal strip 134 has the first end 131, and the first end 131 is electrically connected to the ground plane 11 by a first metal section 161. The second metal strip 135 has the second end 132, and the second end 132 is electrically connected to the ground plane 11 by a second metal section 162. First to third connection points 141 to 143 are disposed on the feed metal line 14. The first metal strip 134 is coupled to the first connection point 141 on the feed metal line 14 through a first capacitive element 171, and the second metal strip 135 is coupled to the second connection point 142 on the feed metal line 14 through a second capacitive element 172. The third connection point 143 on the feed metal line 14 is a feeding point of the antenna element 12, and the second connection point 142 is located between the first connection point 141 and the third connection point 143.

The communication device 10 further includes a frame 101, a matching circuit 18 and a signal source 19. The third connection point 143 on the feed metal line 14 is electrically connected to the signal source 19 through the matching circuit 18, and the signal source 19 is, for example, a transceiver (not illustrated) in the communication device 10. In addition, the matching circuit 18 is configured to increase an operating bandwidth of the antenna element 12. The radiation metal strip 13 and the ground plane 11 are not on the same surface. Specifically, the ground plane 11 and the clearance region 15 are, for example, disposed on a substrate, and the substrate and the frame 101 form an included angle therebetween. In an embodiment, the frame 101 is made of a non-conductive material, and the radiation metal strip 13 is disposed on a surface of the frame 101. In another embodiment, the frame 101 is made of a conductive material. That is, the frame 101 is a metal frame. In addition, the radiation metal strip 13 forms a part of the metal frame, and the first metal section 161 and the second metal section 162 are also configured to form a part of the metal frame.

A length of the second metal strip 135 is greater than a length of the first metal strip 134. A length of the feed metal line 14 is also greater than the length of the first metal strip 134, and the length of the feed metal line 14 is smaller than the length of the second metal strip 135. Since the length of the first metal strip 134 is different from the length of the second metal strip 135, the antenna element 12 generates two different resonant paths. For example, the feed metal line 14, the first capacitive element 171, the first metal strip 134 and the first metal section 161 form a first half-loop path. In addition, a feed signal from the signal source 19 is configured to excite the antenna element 12, and the antenna element 12 generates a first resonant mode through the first half-loop path.

The first resonant mode is in a first frequency band (e.g., a high frequency band) of the antenna element 12. In addition, the first capacitive element 171 in the first half-loop path is configured to provide capacitive coupling, so as to render the first half-loop path equivalent to a resonant path having a capacitively coupled feed and a loop structure. Accordingly, the first half-loop path will have a length smaller than a quarter of a wavelength of a lowest frequency in the first frequency band (e.g., the high frequency band). That is, the excited first resonant mode is a loop resonant mode having a resonant length smaller than the quarter of the wavelength. In other words, a physical length required for the first half-loop path is greatly reduced, thus contributing to reduction in size of the antenna element 12.

On the other hand, the feed metal line 14, the second capacitive element 172, the second metal strip 135 and the second metal section 162 form a second half-loop path. In addition, the feed signal from the signal source 19 is configured to excite the antenna element 12, and the antenna element 12 generates a second resonant mode through the second half-loop path. The second resonant mode is in a second frequency band (e.g., a low frequency band) of the antenna element 12. In addition, the second capacitive element 172 in the second half-loop path is configured to provide capacitive coupling, so as to render the second half-loop path equivalent to another resonant path having a capacitively coupled feed and a loop structure. Accordingly, the second half-loop path will have a length smaller than a quarter of a wavelength of a lowest frequency in the second frequency band (e.g., the low frequency band). That is, the excited second resonant mode is another loop resonant mode having a resonant length smaller than the quarter of the wavelength. In other words, a physical length required for the second half-loop path is greatly reduced, thus contributing to reduction in the size of the antenna element 12.

It is worth noting that the feed metal line 14 is adjacent to the first edge 111 of the ground plane 11. Therefore, the feed metal line 14 and the first edge 111 also form capacitive coupling therebetween. In addition, the capacitive coupling formed by the feed metal line 14 and the first edge 111 results in smoother impedance matching of the antenna element 12 in the first and second resonant modes, or enables the antenna element 12 in the first and second resonant modes to have a dual resonant characteristic, thus contributing to an increase in bandwidths of the first frequency band and the second frequency band.

As a whole, the antenna element 12 is equivalent to a loop antenna having a dual resonant path (i.e., the first half-loop path and the second half-loop path) for operation in the first frequency band and the second frequency band. In addition, the capacitive elements in the dual resonant path are configured to provide capacitive coupling, thus contributing to reduction in the size of the antenna element 12. In this way, the radiation metal strip 13 in the antenna element 12 may be disposed on the frame 101 adjacent to a short edge of the communication device 10, contributing to reduction in size of the clearance region 15.

For example, the radiation metal strip 13 may have a length not greater than that of the short edge of the communication device 10. In other words, in terms of overall configuration, the radiation metal strip 13 does not need to occupy or be extended to the long edge of the communication device 10, and thus contributes to miniaturization of the communication device 10. In addition, in an embodiment, the clearance region 15 has a width t, and the width t is, for example, between 0.5 mm and 4.0 mm. In other words, the communication device 10 has a narrow clearance region 15

(i.e., a narrow metal clearance region) adjacent to the frame 101, such that the metal case of the communication device 10 has a narrow clearance region serving as an antenna window of the antenna element 12. The width t of the clearance region 15 is at least 0.5 mm, thereby separating the radiation metal strip 13 and the ground plane 11 from each other. The width t of the clearance region 15 is at most 4.0 mm, thereby maintaining beauty of the appearance and robustness of the communication device 10.

In addition, the both ends 131 and 132 of the radiation metal strip 13 are electrically connected to the ground plane 11 by the first metal section 161 and the second metal section 162. In other words, open ends of the radiation metal strip 13 are not formed adjacent to the corners at two ends of the short edge. Accordingly, influence of a user's hand on the performance of the antenna element 12 when the user holds the communication device 10 is greatly reduced, thus contributing to an improvement in communication quality of the communication device 10. Furthermore, the first capacitive element 171 and the second capacitive element 172 are, for example, chip capacitive elements.

Figure 2:
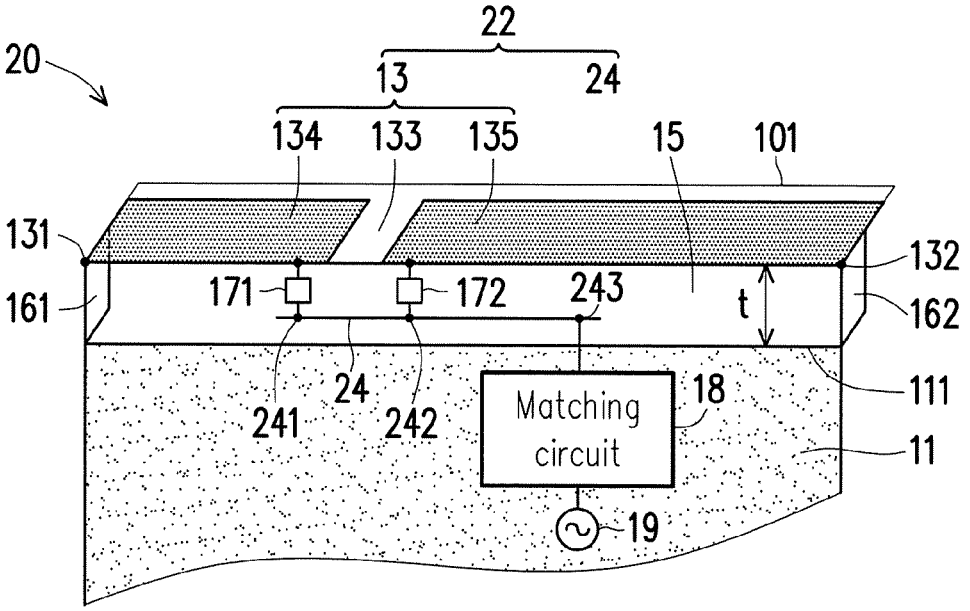
FIG. 2 is a structure diagram of a second embodiment of the communication device of the invention.

FIG. 2 is a structure diagram of the second embodiment of the communication device of the invention. Compared to the embodiment in FIG. 1, an antenna element 22 in a communication device 20 in FIG. 2 includes the radiation metal strip 13 and a feed metal line 24, and the feed metal line 24 includes first to third connection points 241 to 243. In addition, the first connection point 241 and the third connection point 243 are located adjacent to two open ends of the feed metal line 24. By selecting or changing the positions of the first connection point 241 and the third connection point 243, the amount of coupling provided by the feed metal line 24 is properly adjusted, so as to extend equivalent resonant lengths of the first half-loop path and the second half-loop path. Accordingly, frequencies of the generated first resonant mode and second resonant mode are reduced, thus achieving the purpose of minimizing the antenna. Meanwhile, the antenna element 22 is also increased in design flexibility. The detailed structures of the other elements in the embodiment in FIG. 2 are the same as or similar to those of the corresponding elements in the embodiment in FIG. 1, and with the similar structure, the communication device 20 used as an example in the second embodiment in FIG. 2 has similar performance to that in the first embodiment in FIG. 1.

Figure 3:
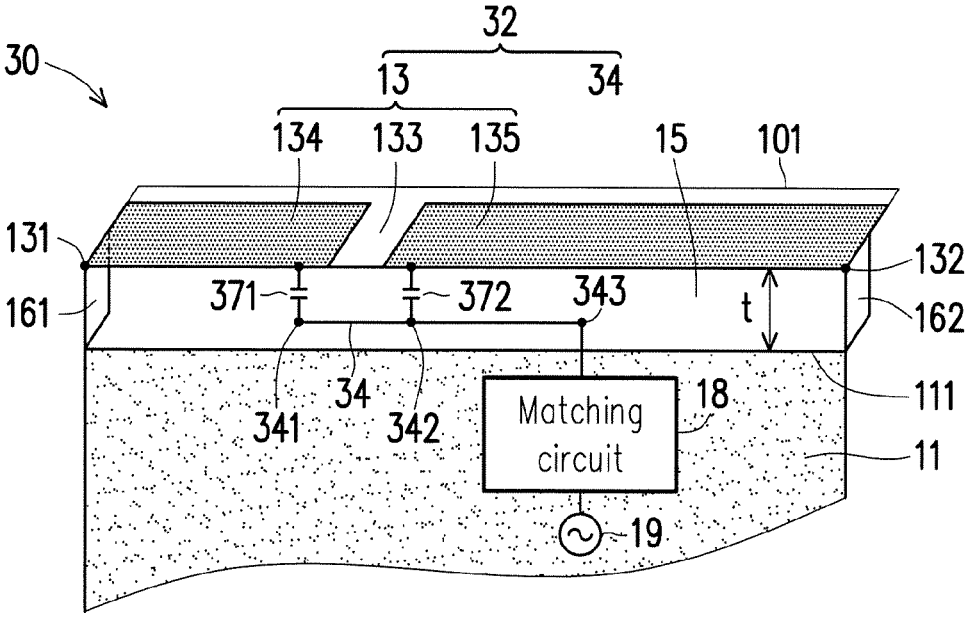
FIG. 3 is a structure diagram of a third embodiment of the communication device of the invention.

FIG. 3 is a structure diagram of the third embodiment of the communication device of the invention. Compared to the embodiment in FIG. 1, an antenna element 32 in a communication device 30 in FIG. 3 includes the radiation metal strip 13 and a feed metal line 34, and the feed metal line 34 includes first to third connection points 341 to 343. In addition, the first metal strip 134 is coupled to the first connection point 341 through a first capacitive element 371, and the second metal strip 135 is coupled to the second connection point 342 through a second capacitive element 372. The first capacitive element 371 and the second capacitive element 372 may be distributed capacitive elements, thus contributing to an increase in design flexibility of the antenna element 32 and a decrease in an amount of chip elements used, so as to enhance industrial usability. The detailed structures of the other elements in the embodiment in FIG. 3 are the same as or similar to those of the corresponding elements in the embodiment in FIG. 1, and with the similar structure, the communication device 30 used as an example in the third embodiment in FIG. 3 has similar performance to that in the first embodiment in FIG. 1.

Figure 4:
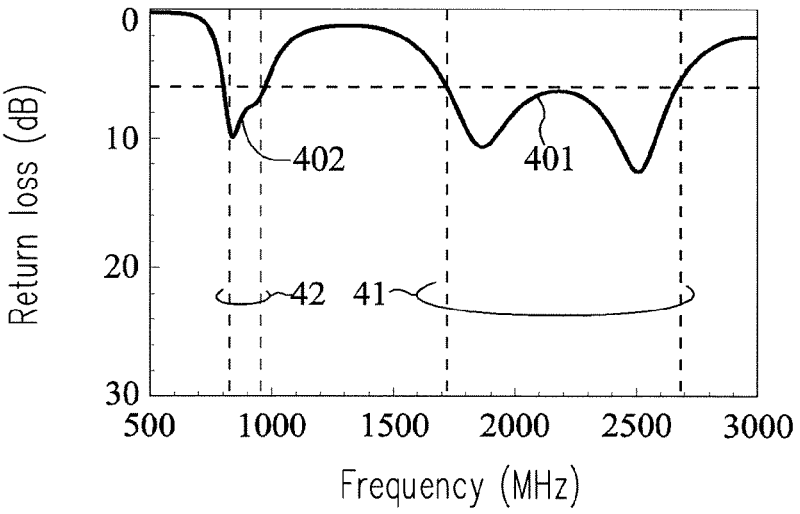
FIG. 4 is a diagram for illustrating return loss of an antenna element of the third embodiment of the invention.

FIG. 4 is a diagram for illustrating return loss of the antenna element of the third embodiment of the invention. In the third embodiment, the ground plane 11 has a length of 130 mm and a width of 75 mm. The radiation metal strip 13 has a length of 75 mm. The first metal section 161 and the second metal section 162 both have a length of 3 mm. The feed metal line 34 has a length of 25 mm. The width t of the clearance region 15 is also 3 mm. A resonant mode 401 is the first resonant mode generated by the first half-loop path, and the resonant mode 401 is in a first frequency band 41. A resonant mode 402 is the second resonant mode generated by the second half-loop path, and the resonant mode 402 is in a second frequency band 42. As shown in FIG. 4, the bandwidth of the first frequency band 41 covers approximately 1710 MHz to 2690 MHz, thus covering relevant operations in LTE and WWAN frequency bands. The bandwidth of the second frequency band 42 covers approximately 824 MHz to 960 MHz, thus covering frequency bands of GSM850, GSM900 and LTE band 5/band 8.

Figure 5:
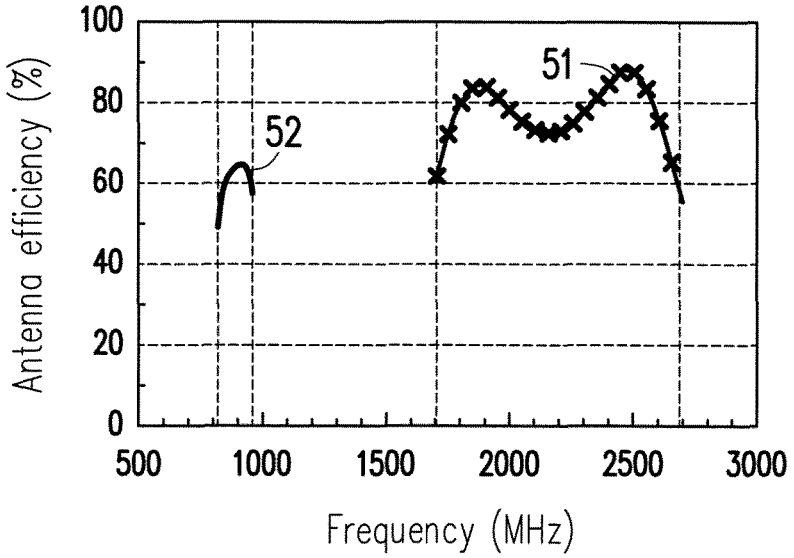
FIG. 5 is a diagram for illustrating antenna efficiency of the antenna element of the third embodiment of the invention.

FIG. 5 is a diagram for illustrating antenna efficiency of the antenna element of the third embodiment of the invention. As shown by an antenna efficiency curve 51 and an antenna efficiency curve 52 in FIG. 5, the antenna efficiency in the first frequency band 41 is approximately 57% to 88%, and the antenna efficiency in the second frequency band 42 is approximately 49% to 66%, thus meeting the requirements of communication devices in actual application.

Figure 6:
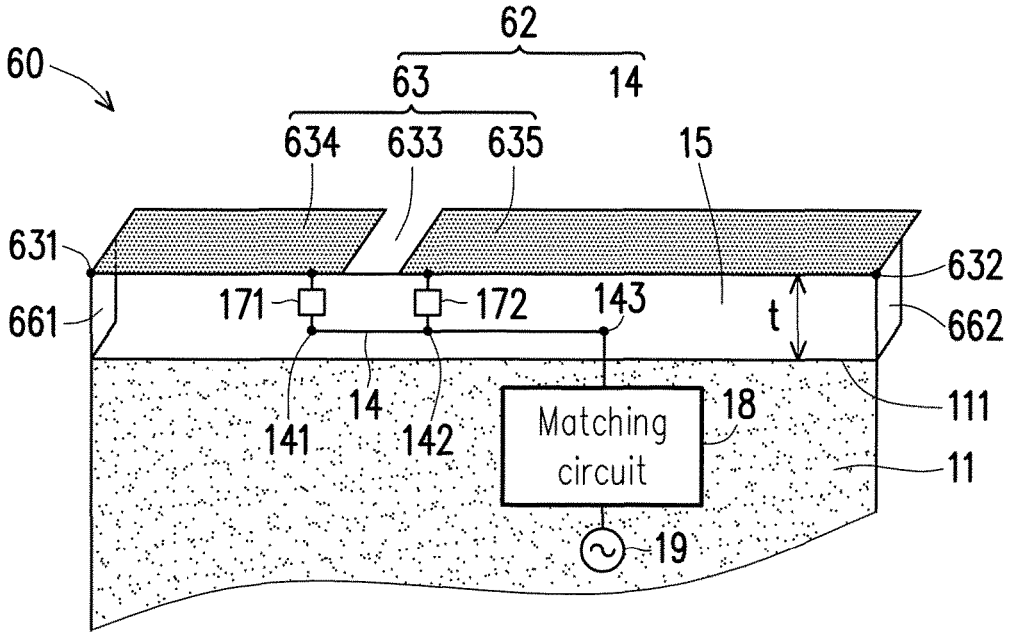
FIG. 6 is a structure diagram of a fourth embodiment of the communication device of the invention.

FIG. 6 is a structure diagram of the fourth embodiment of the communication device of the invention. Compared to the embodiment in FIG. 1, an antenna element 62 in a communication device 60 in FIG. 6 includes a radiation metal strip 63 and the feed metal line 14. In addition, the radiation metal strip 63 has a first end 631 and a second end 632, and the radiation metal strip 63 is divided into a first metal strip 634 and a second metal strip 635 by a gap 633. The first end 631 of the radiation metal strip 63 is electrically connected to the ground plane 11 by a first metal section 661, and the second end 632 of the radiation metal strip 63 is electrically connected to the ground plane 11 by a second metal section 662. Furthermore, the radiation metal strip 63, the first metal section 661 and the second metal section 662 are all configured to form a part of a metal frame of the communication device 60, thus contributing to an improvement in robustness of the communication device 60. The detailed structures of the other elements in the embodiment in FIG. 6 are the same as or similar to those of the corresponding elements in the embodiment in FIG. 1, and with the similar structure, the communication device 60 used as an example in the fourth embodiment in FIG. 6 has similar performance to that in the first embodiment in FIG. 1.

In summary, the antenna element in the communication device of the invention forms a dual resonant path by the radiation metal strip and the feed metal line, thereby achieving multi-band and wide-band operating characteristics. In addition, the capacitive element in the dual resonant path is configured to provide capacitive coupling, thus contributing to reduction in the size of the antenna element. In this way, the metal case of the communication device only needs a narrow clearance region disposed adjacent to a frame of the communication device and configured to serve as an antenna window, thus contributing to an improvement in beauty and robustness of the communication device.

Although the invention has been described with reference to the above embodiments, it will be apparent to persons of ordinary skill in the art that modifications to the described embodiments may be made without departing from the spirit of the invention. Accordingly, the scope of the invention will be defined by the attached claims and not by the above detailed descriptions.

What is claimed is:

1. A communication device comprising:

a ground plane having a first edge; and an antenna element comprising:

a radiation metal strip, divided into a first metal strip and a second metal strip by a gap, wherein the first metal strip is electrically connected to the ground plane by a first metal section, and the second metal strip is electrically connected to the ground plane by a second metal section; and a feed metal line, arranged between the radiation metal strip and the first edge and having a first connection point, a second connection point and a third connection point, wherein the first connection point is coupled to the first metal strip through a first capacitive element, the second connection point is coupled to the second metal strip through a second capacitive element, the third connection point is a feeding point of the antenna element, and the second connection point is located between the first connection point and the third connection point.

2. The communication device according to claim 1, wherein the radiation metal strip and the ground plane are not on the same surface, and the radiation metal strip is disposed on a surface of a frame of the communication device or forms a part of a metal frame of the communication device.

3. The communication device according to claim 1, wherein a length of the radiation metal strip is not greater than a length of a short edge of the communication device.

4. The communication device according to claim 1, wherein the first metal section and the second metal section are a part of a metal frame of the communication device.

5. The communication device according to claim 1, wherein the radiation metal strip and the feed metal line are extended along the first edge.

6. The communication device according to claim 5, wherein the radiation metal strip and the ground plane are separated by a clearance region, and the ground plane is not disposed in the clearance region.

7. The communication device according to claim 6, wherein the clearance region has a width between 0.5 mm and 4.0 mm.

8. The communication device according to claim 5, wherein a length of the second metal strip is greater than a length of the first metal strip.

9. The communication device according to claim 5, wherein a length of the feed metal line is greater than a length of the first metal strip and smaller than a length of the second metal strip.

10. The communication device according to claim 1, wherein the feed metal line, the first capacitive element, the first metal strip and the first metal section form a first half-loop path, the first half-loop path generates a first resonant mode, and the first resonant mode is in a first frequency band of the antenna element.

11. The communication device according to claim 10, wherein the feed metal line, the second capacitive element, the second metal strip and the second metal section form a second half-loop path, the second half-loop path generates a second resonant mode, and the second resonant mode is in a second frequency band of the antenna element.

12. The communication device according to claim 11, wherein the feed metal line is extended along the first edge.

13. The communication device according to claim 12, wherein the feed metal line is adjacent to the first edge to form a capacitive coupling between the feed metal line and the first edge.

14. The communication device according to claim 1, wherein the first capacitive element is a chip capacitive element or a distributed capacitive element.

15. The communication device according to claim 1, wherein the second capacitive element is a chip capacitive element or a distributed capacitive element.

16. The communication device according to claim 1, wherein the third connection point on the feed metal line is further electrically connected to a signal source of the communication device through a matching circuit.

* * * * *